US005637820A

United States Patent [19]

Wittman

[11] Patent Number: 5,637,820

[45] Date of Patent: Jun. 10, 1997

[54] STRINGED INSTRUMENT WITH ON-BOARD TUNER

[76] Inventor: Kenneth L. Wittman, 691 Woodland Ave., Williamsport, Pa. 17701

[21] Appl. No.: 369,620

[22] Filed: Jan. 6, 1995

[51] Int. Cl.[6] ..... G10G 7/02

[52] U.S. Cl. ..... 84/454; 84/DIG. 18; 84/327

[58] Field of Search ..... 84/312 R, 454, 84/DIG. 18, 327

[56] References Cited

U.S. PATENT DOCUMENTS

| | | | |
|---|---|---|---|
| 4,018,124 | 4/1977 | Rosado | 84/454 |
| 4,120,229 | 10/1978 | Ota | 84/454 |
| 4,320,689 | 3/1982 | Pogoda | 84/454 |
| 4,338,846 | 7/1982 | Pogoda | 84/454 |
| 4,741,242 | 5/1988 | Aronstein | 84/454 |
| 4,899,636 | 2/1990 | Chiba et al. | 84/454 |
| 5,396,827 | 3/1995 | Miller et al. | 84/454 |

FOREIGN PATENT DOCUMENTS

| | | |
|---|---|---|
| WO8707068 | 11/1987 | WIPO . |
| WO9000791 | 1/1990 | WIPO . |

*Primary Examiner*—Cassandra C. Spyrou
*Attorney, Agent, or Firm*—Sughrue, Mion, Zinn, Macpeak & Seas

[57] ABSTRACT

A stringed instrument with an on-board tuner which detects vibrations of the strings and determines and displays the identity of the string which is being played and the deviation of the string's pitch relative to an in-tune reference pitch. The tuner display is situated such that it is not readily visible to casual observers, such as an audience, yet is oriented such that the musician can easily view the tuner display from a normal playing position. In the case of an electric stringed instrument, the display is inlaid in the top surface of the neck of the instrument near the instrument's body. In the case of an acoustic stringed instrument, the tuner is mounted inside the body of the instrument and is visible through the sound hole. The instrument is provided with a strap assembly which attaches to a balanced pivot point on the instrument and provides a single connection which serves as both an electrical connection to the amplifier and a mechanical connection to the strap assembly. The strap assembly enables the musician to remove and attach different instruments without removing the strap assembly. The instrument body is contoured to follow the shape of the musician's body, thereby minimizing the torque experienced by the musician through the strap assembly. The lower portion of the instrument body is tapered to substantially eliminate the lower horn portion, allowing the musician to play the instrument in the same position regardless of whether the musician is sitting or standing.

20 Claims, 8 Drawing Sheets

FIG. 1
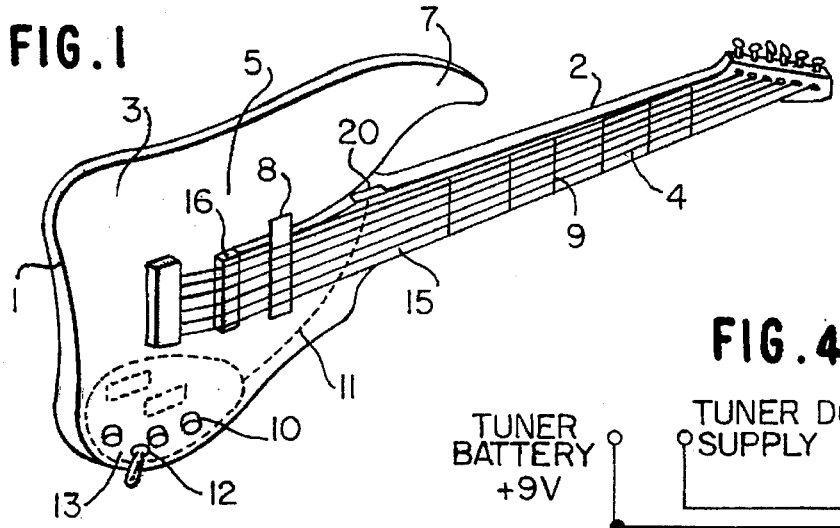
FIG. 4
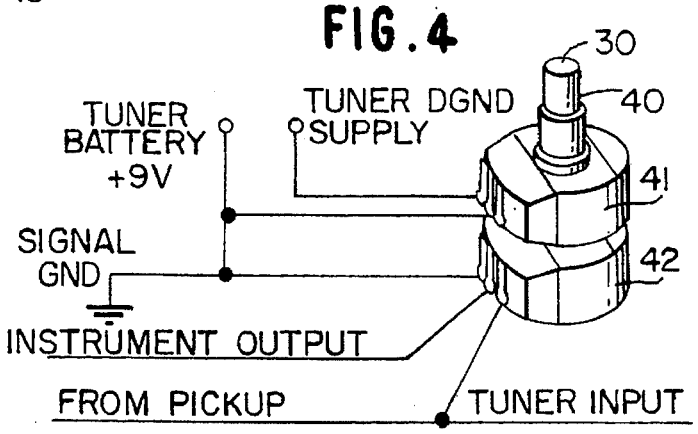
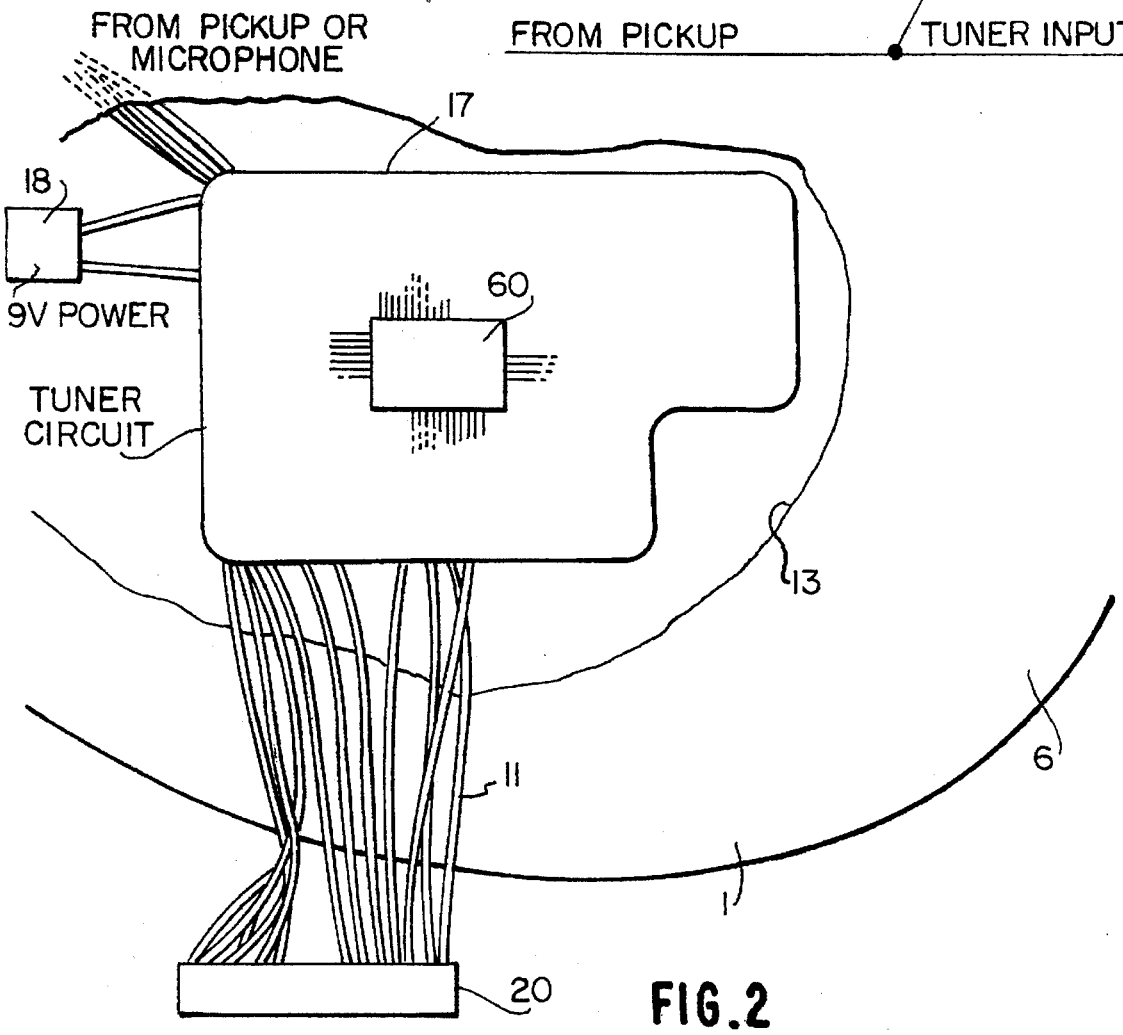
FIG. 2

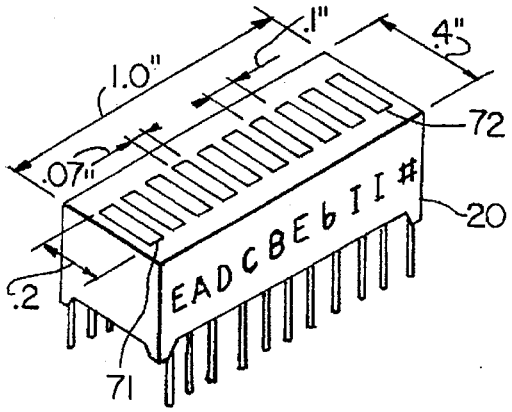
FIG.7a
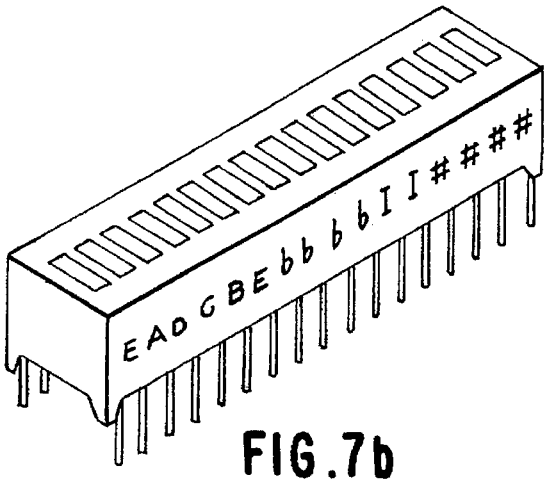
FIG.7b
FIG.8
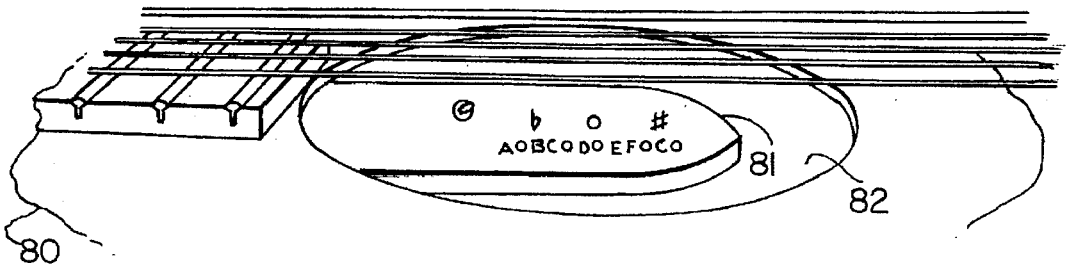
FIG.9a
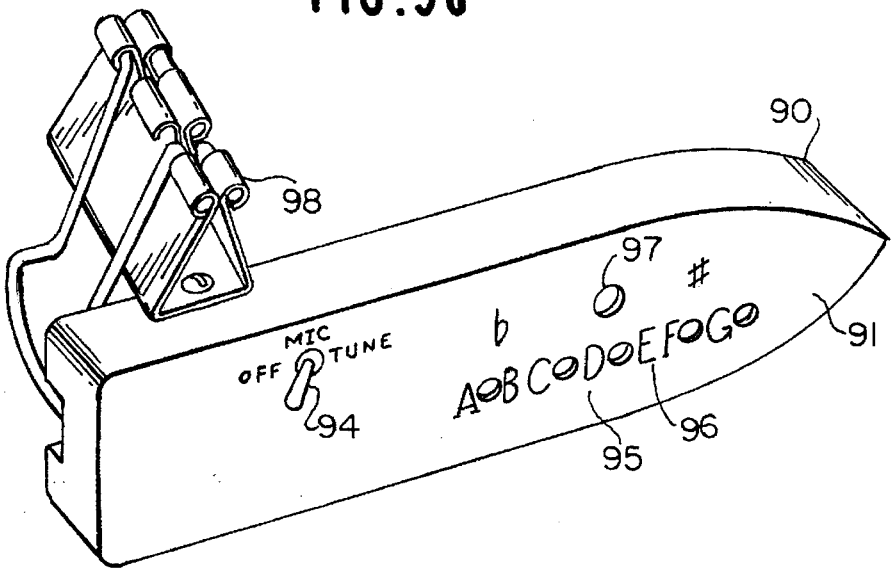

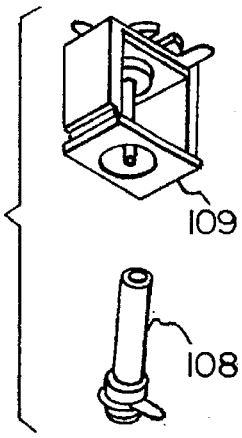
FIG.13a
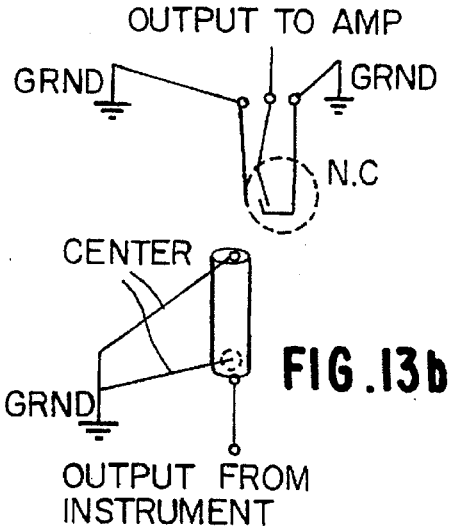
FIG.13b
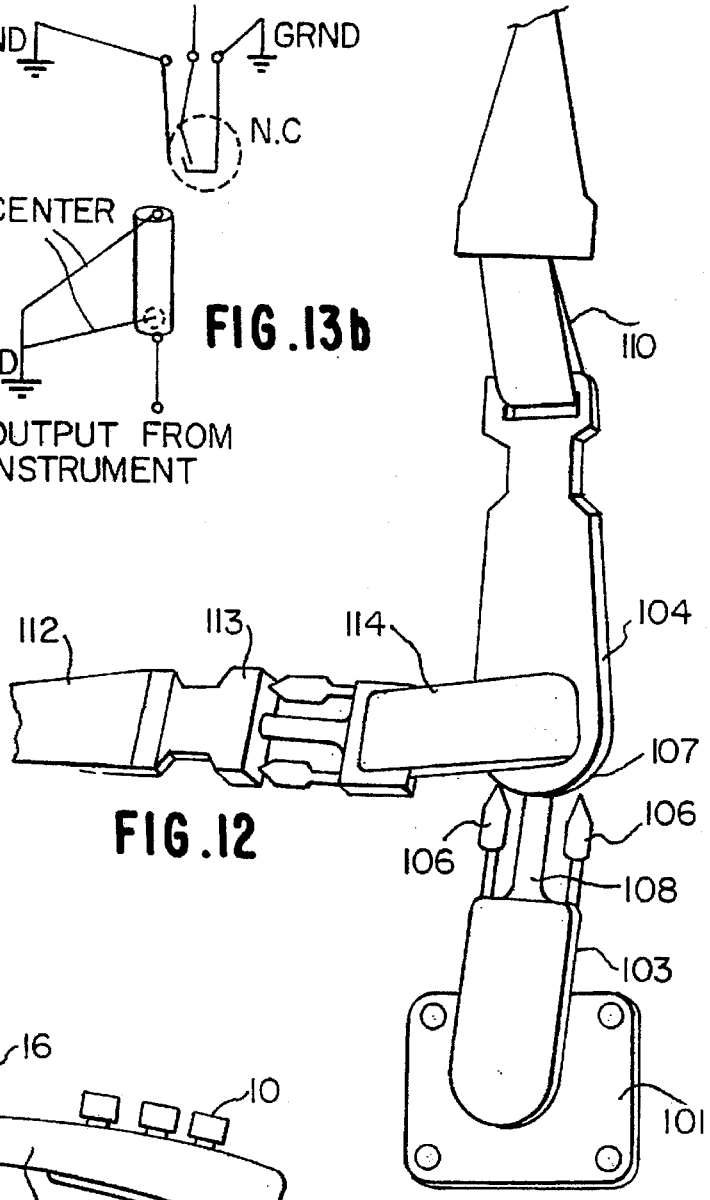
FIG.12
FIG.15
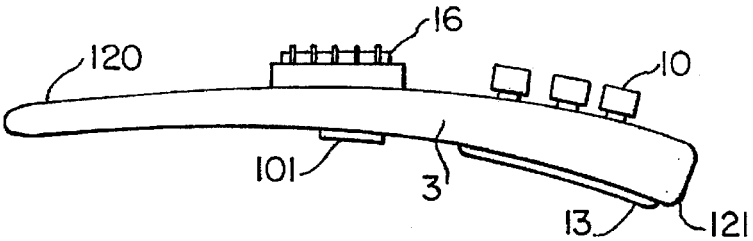
FIG.14
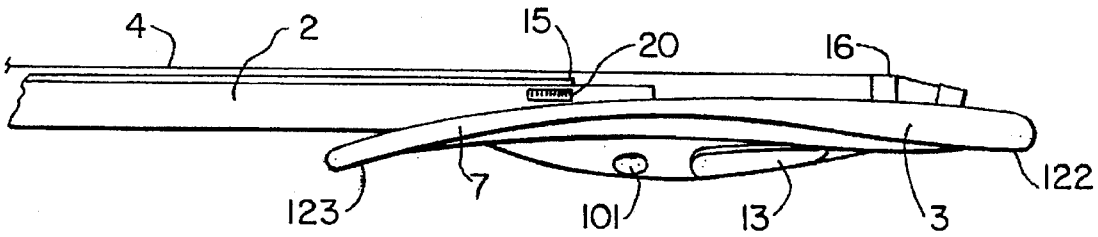

FIG. 17

MEANS ± SD OF MAXIMUM NORMALIZED RMS EMG DATA BY SIDE

| | SLOW 60 | | MEDIUM 110 | | FAST 160 | |
|---|---|---|---|---|---|---|
| | RIGHT | LEFT | RIGHT | LEFT | RIGHT | LEFT |
| CONVENTIONAL STRAP | 1.711<br>.455 | 2.067<br>.775 | 2.014<br>.420 | 2.083<br>1.044 | 2.161<br>1.067 | 2.354<br>.760 |
| SPINSTRAP | 1.086<br>.363 | .945<br>.206 | 1.483<br>.426 | 1.235<br>.255 | 1.551<br>.505 | 1.373<br>.462 |

STRINGED INSTRUMENT WITH ON-BOARD TUNER

FIELD OF INVENTION

This invention relates to a stringed instrument having an on-board tuner which allows a musician to tune the instrument rapidly during a musical performance without diverting attention to any external devices.

Another aspect of the invention relates to an improved strap assembly which permits the musician to remove one instrument and attach another instrument without having to remove the strap assembly or disconnect a separate connector cable. The strap assembly works in conjunction with an ergonomic instrument body shape which conforms to the musician's body, thereby minimizing torque on the musician's neck and shoulders.

BACKGROUND OF THE INVENTION

A commonly known problem related to stringed instruments is their natural tendency not to stay in tune. Temperature fluctuations are one major cause of this problem. As the ambient temperature increases, the pitch of instrument strings tends to become sharp, and conversely, as the temperature decreases, the pitch of instrument strings tends to become flat. As a result, musicians are required to re-tune their stringed instruments frequently. This problem is particularly acute for performing musicians, because the ambient temperature tends to increase rapidly during performances due to stage lighting. With conventional tuners, the performing musician's opportunities to tune an instrument during a performance are severely limited, since the attendant tuning process is cumbersome. For instance, with electric stringed instruments, the musician must divert attention away from the instrument and the audience in order to focus on a remotely located tuner which is connected to the instrument via an output cable. In the case of an acoustic stringed instrument, an additional difficulty exists; external noise contends with the sound from the string being tuned and interferes with the tuner properly discerning the string's pitch. As a result, it is generally practical for a performing musician to tune only before a performance or during breaks between sets, often resulting in unacceptably poor tuning during performance.

Attempts have been made in the art to provide stringed instruments with on-board or built-in tuners. However, no existing tuner has satisfactorily provided a convenient system that minimizes the time and effort required by a performing musician to tune a stringed instrument during the course of a performance.

International Application No. PCT/US89/02923 (Weise) discloses an integrated guitar tuning system, wherein a tuning circuit is built into a guitar, and a display comprising a pair of light emitting diodes (LEDs) is mounted on the surface of the guitar body. One LED is illuminated to indicate that the string being tuned is sharp, and the other LED is illuminated to indicate the string being tuned is flat. However, the display does not indicate which string is being tuned and does not indicate the degree to which the string is out of tune. In addition, the display is oriented outward from the front face of the guitar body such that the LEDs are visible to anyone viewing the front of the guitar, such as an audience.

International Application No. PCT/GB87/00302 (George) is directed to a tuning aid located on the front face of a guitar body, which includes: a dedicated pickup for sensing the pitch of the strings; and a row of LEDs situated beneath the strings. Each LED corresponds to a string and is illuminated when the corresponding string is played and in tune. Four additional LEDs are used to indicate whether the played string is in tune. One LED is illuminated when the pitch of the string is flat; a second LED is illuminated when the pitch of the string is sharp; and the final two LEDs are illuminated when the pitch of the string is in tune. The display is readily visible to one viewing the front of the guitar, such as the audience. However, the display is not conveniently located so as to be easily viewed by the musician while holding the guitar in a normal playing position. In addition, the sharp and flat LEDs do not indicate the extent to which the pitch of a string deviates from the in-tune reference pitch.

US Pat. No. 4,899,636 (Chiba) relates to a tuning apparatus which mounts on an external surface of an instrument via a suction cup and determines pitch by sensing vibrations via a piezoelectric element. The apparatus relies on vibrations being transmitted through the body of the instrument, and therefore is not suitable for stringed instruments such as electric guitars. The external mounting necessarily results in the tuning apparatus protruding from the instrument, which may be aesthetically or functionally undesirable to the musician. The display of the apparatus is an analog meter which requires a relatively large display area. Further, in order to properly attach to the instrument, the suction cup requires a substantially plane surface area, which limits the selection of desirable mounting locations.

Another problem encountered by performing musicians is the difficulty of switching from one instrument to another instrument during a performance. With an instrument having a conventional support strap and amplifier cord, the musician must first unplug the amplifier cord, and then remove both the instrument and strap by lifting the strap over the musician's head. Next, the second instrument, together with its strap, must be placed over the musician's shoulder, and the amplifier cord must be reattached. This procedure is awkward and time consuming and can only be accomplished when there is a significant amount of time between selections and rarely during performance.

In addition, stringed instruments with conventional straps tend to impart significant torque forces to the neck and shoulders of the musician, which, over time, can result in chronic pain or discomfort. This torque is caused by the inherent imbalance in the distribution of the weight of the guitar on the musician's shoulders. This problem is especially troublesome with instruments having a larger-than-conventional number of strings. For example, a six string bass guitar requires a larger and heavier headstock than a conventional four string bass guitar in order to accommodate the additional strings. In order to counter balance the additional weight of the headstock, the weight of the body of the guitar must be increased by approximately three times the additional weight of the headstock. This additional weight increases the torque forces experienced by the musician. In addition, ease of mass-production dictates that most stringed instruments have planar slab bodies. However, when the conventional instrument is held in a normal playing position, the slab body shape causes a significant amount of the instrument's mass to extend out from the musician's body, thereby contributing to the torque experienced by the musician through the strap assembly.

Finally, conventional stringed instruments, such as guitars, are shaped such that musicians are forced to hold the guitar in a different playing position while sitting than while standing. The lower portion of a conventional guitar includes a lower horn. When a musician is sitting, this lower horn rests against the musician's leg, thereby preventing the musician from orienting the guitar at certain angles. If the musician tends to practice while sitting and perform while standing, this limitation on the guitar's angular orientation leads to inconsistent playing conditions which may have an adverse affect on the quality of the musician's performance.

SUMMARY OF THE INVENTION

It is therefore an objective of the present invention to provide a stringed instrument having an on-board tuner for the purpose of easily and conveniently tuning the instrument at any time without having to divert attention away from the stringed instrument.

It is a further objective of the present invention is to provide an on-board tuner which is compact and discreetly located on or within a stringed instrument, yet is clearly visible and easily read by a musician holding the stringed instrument in a normal playing position.

Another objective of the present invention is to provide an accurate visual display indicating which string is being tuned and the degree to which the pitch of the string varies from an in-tune reference pitch.

Another objective of the present invention is to provide the capability to tune a stringed instrument to concert pitches without requiring recalibration of tuner.

Another objective of the present invention is to provide a stringed instrument having an on-board tuner which is integrated into the instrument's existing electronics and takes advantage of the instrument's existing control devices to activate and deactivate the tuner.

Another objective of the present invention is to provide a stringed instrument having a strap assembly which allows the musician to remove and attach different instruments rapidly without having to remove the strap assembly or to remove or attach a separate output cable.

Another objective of the present invention is to provide a light-weight ergonomic stringed instrument and strap assembly which minimize the torque forces experienced by the musician.

Another objective of the present invention is to provide a stringed instrument having a body which is contoured to minimize torque forces experienced by the musician and to provide a connection for the strap assembly.

Another objective of the present invention is to provide a stringed instrument having a light-weight contoured body and strap assembly such that the musician can hold the instrument in the same playing position whether sitting or standing.

In order to achieve these objectives, a stringed instrument is provided with an on-board tuner which is completely contained within the instrument. According to one feature of the present invention, the tuner detects vibrations of the strings through the existing pickup and determines which string is being played and the deviation of the string's pitch relative to an in-tune reference pitch. A tuner circuit employs a quartz crystal to accurately compare the string's pitch to in-tune reference pitches which are digital stored and never require recalibration. The tuner display is compact and situated such that it is not readily visible to casual observers such as an audience, yet is oriented such that the musician can easily and conveniently view the tuner display from a normal playing position. The tuner display thereby enables the musician to quickly tune the instrument from a playing position without requiring the musician to focus on anything other than the instrument.

In a first embodiment, an electric stringed instrument, such as an electric guitar, is provided with a tuner circuit which can be activated, for instance, by turning the instrument's volume control to the minimum setting. The tuner circuit receives signals from the instrument's pickup and compares the signal's pitch information to a stored reference pitch. The tuner circuit drives a display which is in-laid in the top surface of the neck of the instrument near the instrument's body. The display is flush with the instrument's surface and comprises a series of light emitting elements. A string reader portion of the display indicates which string is being played, and a tune indicator portion indicates the degree of error (sharp or flat) between the string's pitch and the in-tune reference pitch. Two centrally located in-tune light emitting elements are illuminated to indicate that the string's pitch is in-tune. Light emitting elements indicating that the string's pitch is sharp or flat are located on opposite sides of the in-tune elements. The degree to which the string's pitch is sharp or flat is indicated by the rate at which the sharp and flat elements blink. Alternatively, rows of sharp and flat elements can be located on opposite sides of the in-tune elements, such that increasing pitch error is indicated by illuminating successively further displaced elements.

In a second embodiment, an acoustic stringed instrument, such as an acoustic guitar, is provided with a stand-alone tuner which is mounted inside the instrument and is visible through the instrument's sound hole. The tuner includes a condenser microphone which picks up the acoustic vibrations of the strings and sends corresponding electrical signals to a tuner circuit which is similar to that of the first embodiment. The location of the tuner microphone within the instrument advantageously prevents background interference from disrupting the tuning process by shielding the microphone from external noise. The tuner is provided with a three-way switch which allows the musician to activate the tuner or provide the microphone output to an output jack for amplification. The tuner display is located on the front face of the stand-alone tuner and includes a string reader portion having a light emitting element for each of the twelve notes in an octave and a tune indicator portion consisting of three light emitting elements representing in-tune, sharp and flat. The degree to which the string's pitch is sharp or flat is indicated by the rate at which the sharp and flat LEDs blink.

In another aspect of the present invention, the stringed instrument is provided with a strap assembly which attaches to a balanced pivot point on the instrument and provides a single connection which serves as both an electrical connection to the amplifier and a mechanical connection to the strap assembly. The strap assembly enables the musician to remove and attach different instruments without removing the strap assembly or removing and attaching a separate electrical connection. The strap assembly advantageously minimizes the torque forces applied to the musician's neck and shoulders by equally distributing the weight of the instrument due to the balanced pivot point mounting.

In another aspect of the present invention, the stringed instrument is contoured to follow the shape of the musician's body, thereby reducing the effective moment arm of the body and minimizing the torque experienced by the musician through the strap assembly. The instrument body curves out of the plane of the neck towards the musician in both the longitudinal and transverse directions, and the thickness of the body is gradually reduced towards the upper portion of the body. The instrument shape also allows the strap attachment point to be positioned such that the instrument is balanced in three dimensions, and prevents the strap attachment from protruding from the rear face of the instrument.

The lower portion of the instrument body is tapered to substantially eliminate the lower horn portion, allowing the musician to play the instrument in the same position regardless of whether the musician is sitting or standing. The tapered shape further serves to reduce the weight of the instrument, and consequently, reduces the torque experienced by the musician.

These and other objectives and features of the present invention will be apparent from the following detailed description of the preferred embodiments.

BRIEF DESCRIPTION OF THE DRAWINGS

FIG. 1 is a perspective view showing a stringed instrument having an on-board tuner and body contour according to a first embodiment of the present invention.

FIG. 2 is a plan view of the lower back face of the stringed instrument with a cut-away showing the instrument control cavity.

FIG. 4 is a schematic diagram of a ganged volume pot circuit.

FIG. 7*a* is a perspective view of the tuner display according to the first embodiment of the present invention.

FIG. 7*b* is a perspective view of an alternate tuner display according to the first embodiment of the present invention.

FIG. 8 shows an angular view of the front face of an acoustic instrument looking into the sound hole from beyond the top portion of the instrument, whereby the display of a tuner according to a second embodiment of the present invention can be seen.

FIG. 9*a* is a perspective view showing the tuner for an acoustic string instrument of the second embodiment of the present invention.

FIG. 12 is a close-up view of the components of the strap assembly.

FIG. 13*a* is a schematic diagram of the electrical connectors of the strap assembly.

FIG. 13*b* is a circuit diagram of the electrical connectors of the strap assembly.

FIG. 14 is a top view of the instrument showing the three dimensional shape of the instrument's body along a longitudinal x-axis.

FIG. 15 is a side view of the instrument showing the three dimensional shape of the instrument's body along a transverse y-axis.

FIG. 17 is a table showing the results of a study comparing the muscle activity resulting from use of the '259 strap assembly to the muscle activity resulting from use of a conventional strap.

DETAILED DESCRIPTION OF THE PREFERRED EMBODIMENTS

Figure 3:
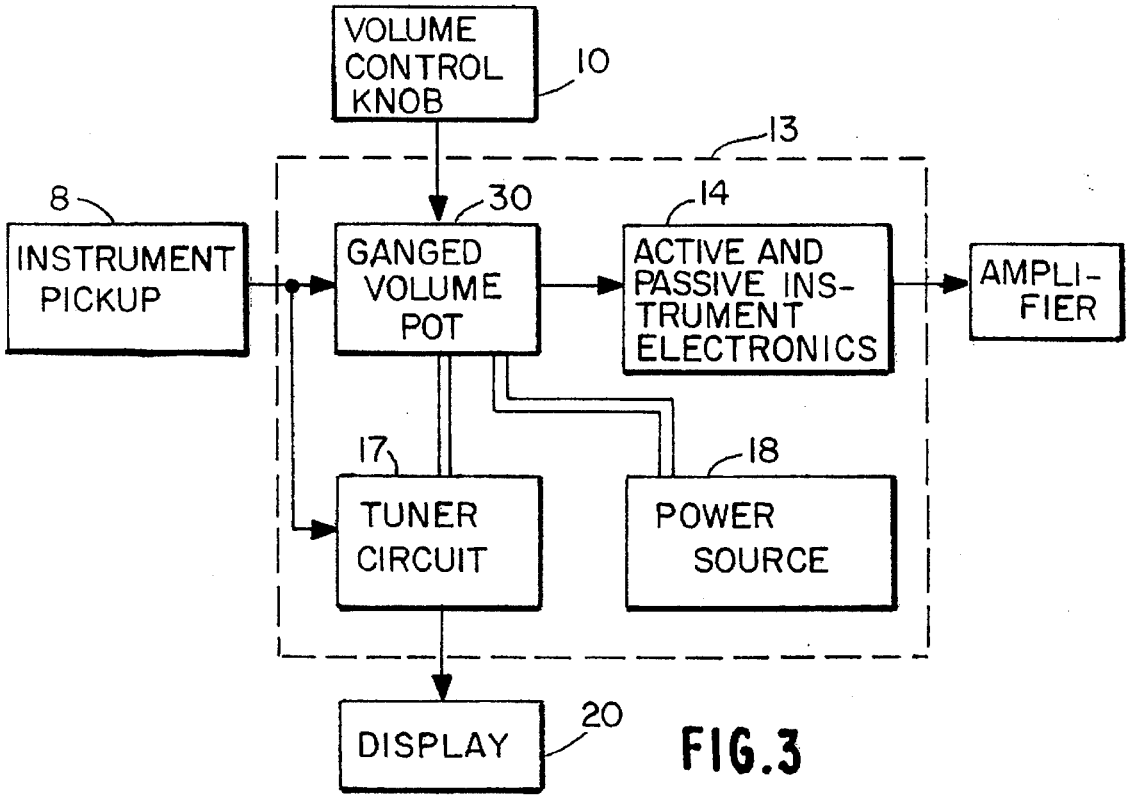
FIG. 3 is a block diagram of the tuner of the present invention.

The present invention will be described in detail using some specific embodiments with reference to the accompanying drawings. In the context of the present invention, a stringed instrument is any instrument which uses strings to produce musical notes, including rhythm instruments such as guitars and string instruments conventionally used in orchestras.

Referring to FIG. 1, an electric stringed instrument 1 is provided with a tuner according to a first embodiment of the present invention. The electric stringed instrument 1 can be any conventional electric guitar or bass guitar or variation thereof having a neck 2, a body 3, and a set of strings 4 which vibrate to produce musical notes of different pitch. The body has a front face 5, a rear face 6 and an upper horn portion 7. The instrument 1 is provided with at least one conventional pickup 8 which lies beneath the strings 4 between the end of the fingerboard 15 and the bridge 16. The pickup 8 senses the vibrations from the strings 4 and generates electrical pitch signals representative of the pitch of the vibrations.

As illustrated in FIG. 2, a control cavity 13 is cut into the lower portion of the back face 6 of the body 3. Contained within the control cavity 13 is active and passive electronic control circuitry 14 for receiving and processing the electrical signals generated by the pickup 8. The control circuitry 14 includes volume control circuitry which will be described below in conjunction with the tuner of the present invention. The volume control circuitry generates an output volume signal which is sent to an external amplifier and speakers (not shown).

Referring again to FIG. 1, a volume control knob 10 is located on the front face 5 of the guitar body 3. The volume control knob 10 is connected to the volume control circuitry and allows the musician to adjust the amplitude of the output volume signal.

The tuner includes a tuner circuit 17 and an independent power source 18, such as a battery. The tuner circuit 17 and power source 18 are preferably located within the existing control cavity 13. Alternatively, if the control cavity 13 does not have sufficient space, the tuner circuit 17 and battery 18 can be located in a separate cavity located, for example, between the end of the neck 2 and the pickup 8. In the case of a jazz guitar (not shown) which typically has a large pick guard located on the lower portion of the body, the tuner circuit can be mounted underneath the pick guard.

The tuning apparatus also includes a display 20 inlaid into the top surface of the neck 2 near the body 3. Alternatively, the display 20 could be located on the upper horn portion 7 of the body 3. The display 20 consists of a series of light emitting elements such as LEDs. The LEDs are oriented upwards such that they are clearly visible to the musician while the instrument 1 is being held in a playing position. The display 20 is connected to the tuner circuit 17 via an interconnect cable 11 which is routed though the body 3 of the instrument 1. The control and operation of the display 20 will be described in greater detail hereinbelow.

Turning next to the tuner block diagram of FIG. 3, the electrical pitch signal from pickup 8 is sent to a special ganged volume pot circuit 30. As shown in FIG. 4, the ganged volume pot circuit 30 consists of a common shaft 40 carrying two 250 kΩ volume pots 41 and 42. The shaft 40 is connected to the volume control knob 10, and rotates as the volume control knob 10 is turned by the musician. When the volume control knob 10 is turned up, the ground to the tuner circuit 17 is disconnected, thereby disabling the tuner, and the pickup signal is passed only to the volume control circuitry. The tuner uses a positive ground system so that the tuner circuit ground corresponds to the positive battery voltage. Because the tuner circuit 17 is disconnected by the ganged volume pot circuit 40, the tuner circuit 17 does not cause any additional loading on the system which could impact sound quality.

Conversely, when the volume control knob 10 is turned to the minimum setting, the pickup signal is passed to the tuner circuit 17 and the volume control circuitry is shorted to ground. As a result, the tuner is only operational when the instrument's volume signals are not being amplified. The tuner circuit 17 is powered by a power source 18 which can be, for instance, a 9 volt battery.

Figure 5:
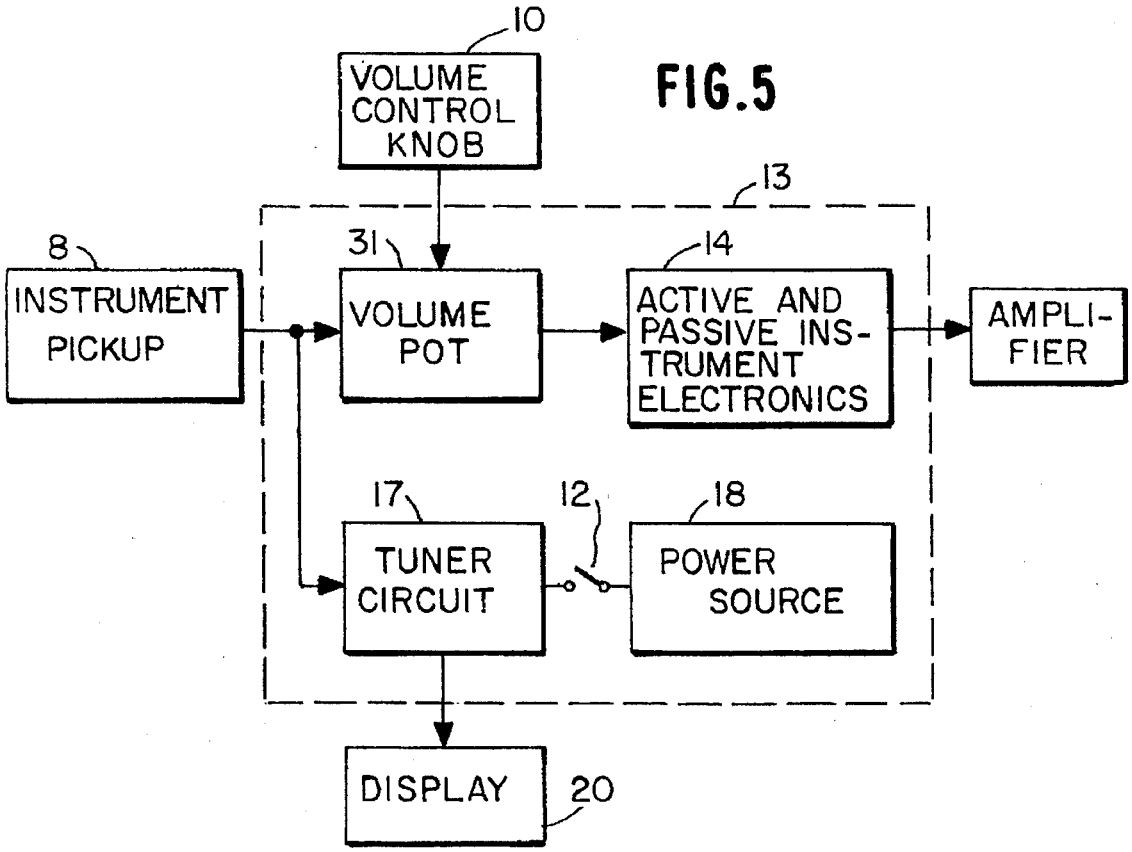
FIG. 5 is a block diagram of the tuner of the present invention showing an alternate scheme for activating the tuner.

The block diagram of FIG. 5 illustrates an alternate scheme for activating the tuner. The tuner circuit 17 is wired before the volume pot circuit 31. As a result, the tuner will always receive the pickup signal, regardless of the instrument's volume output. Instead of being activated by the volume control knob 10, the tuner is activated by an on/off switch 12 located near the volume control knob 10 on the front face 5 of the instrument 1 (see FIG. 1). The tuner circuit 17 is designed with a very high input impedance to prevent any significant loading of the instrument's circuitry and volume output, resulting in a negligible impact on sound. If the musician desires to tune the instrument between songs, the volume to the amplifier can be turned down via the volume control knob 10 so that no sound is emitted while tuning. Consequently, the instrument can be tuned while plugged into the amplifier.

Figure 6:
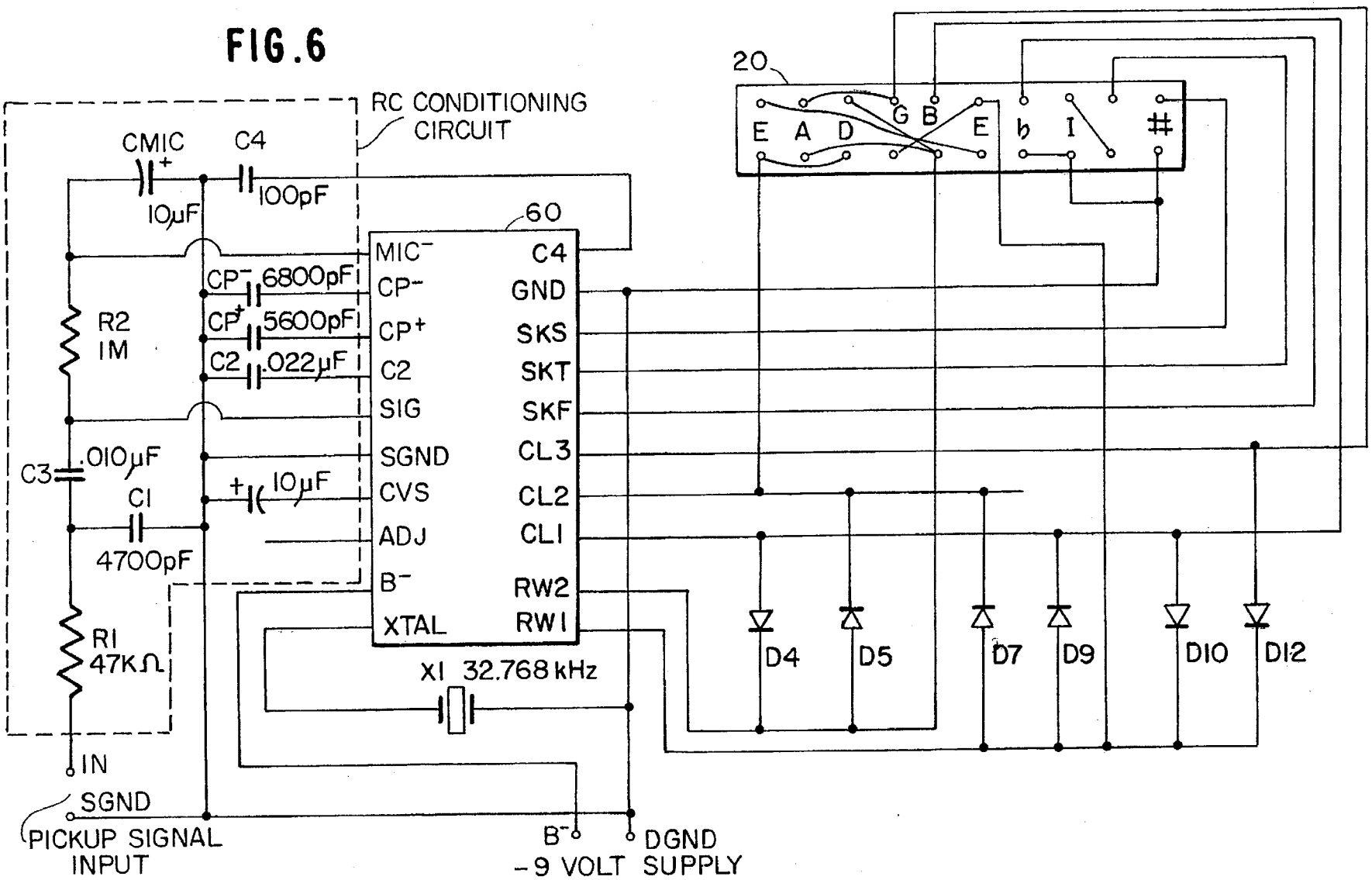
FIG. 6 is a circuit diagram of the tuner circuit of the present invention.

FIG. 6 shows a circuit diagram of the tuner circuit according to the first embodiment of the present invention. The circuit includes a modified VLSI chip 60 which receives the pickup pitch signals and determines the relative pitch represented by the signal. The pickup pitch signals are processed through RC conditioning circuit 61 to generate the chip input signals. The RC conditioning circuit can be any conventional circuit which modifies the pickup signal to be compatible with the particular input configuration of the chip 60.

The chip 60 includes a memory which stores digital pitch reference values representing the pitch of musical notes. The memory preferably contains reference values for each of the 12 notes (chromatic) in an octave. The pickup pitch signal is compared to the digital pitch reference values to determine which note is being played by determining which of the pitch reference values is closest in frequency. The chip 60 also measures the frequency difference between the closest pitch reference value and the pickup pitch signal. The chip 60 preferably is capable of comparing pitches over a seven octave range from C1 through B8.

The chip 60 generates output signals which drive the tuner display 20. Regardless of the particular display configuration, the chip 60 provides output signals (RW1, RW2, CL1, CL2 and CL3) which drive twelve pitch indicator diodes via a digital matrix signal scheme. As described below, any subset of these diodes can be used to form a custom display, depending on the pitch and number of strings of a particular instrument. The chip 60 also provides signals indicating the frequency difference between the pickup pitch signal and the closest pitch reference value. In particular, the chip 60 generates one signal (SKT) indicating that the pickup pitch signal is in tune, another signal (SKF) indicating a degree of flatness and another signal (SKS) indicating a degree of sharpness. The chip 60 preferably uses a high accuracy quartz crystal accurate to ± one cent and can be any suitable off-the-shelf chip, such as the ST-1000 IC by Micanopy Microsystems Inc (called the Q chip).

As illustrated in FIG. 7*a*, the tuner display 20 consists of two portions: a string reader portion 71; and a tune indicator portion 72. The string reader portion 71 indicates which note is being played and includes an LED for each string on the instrument. For instance, for a standard electric guitar, the string reader 71 consists of six LEDs representing the E A D G B E strings. A four string bass guitar uses a string reader 71 with LEDs for the E A D G strings, a five string bass guitar uses a string reader 71 with LEDs for the B E A D G strings, and a six string bass guitar uses a string reader 71 with LEDs for the B E A D G C strings. Since the tuner circuit determines the string's pitch relative to any of the 12 notes of an octave, the tuner circuit remains the same, irrespective of the particular elements of the string reader portion of the display.

The tune indicator portion 72 of the display indicates whether the pitch of string is in tune, sharp or flat. If the pitch is in tune, two centrally located LEDs are illuminated. If the pitch is sharp, an LED to the right of the in tune LEDs is illuminated, and if the pitch is flat, an LED to the left of the in tune LEDs is illuminated.

Two different mechanisms will be described for displaying the degree to which the pitch is sharp or flat. In the first mechanism shown in FIG. 7*a*, only one LED is used to indicate a sharp pitch and one LED is used to indicate a flat pitch. The LEDs flash to indicate the degree to which the pitch of the string is out of tune. For example, the LEDs blink four times per second for every 10 cents error. Thus, if the pitch is 20 cents sharp, the right LED would blink eight times per second.

In another mechanism for display the degree to which the pitch is sharp or flat, one row of LEDs is located on one side of the in-tune LEDs, indicating that the pickup pitch signal is sharp, and another row of LEDs is located on the other side of the in-tune LEDs indicating that the pickup pitch signal is flat. Each LED corresponds to a range of sharpness or flatness, and LEDs positioned successively further from the in-tune LEDs indicate a greater degree of sharpness or flatness. For instance, 4 LEDs may be located on either side of the in-tune LEDs, as shown in FIG. 7*b*. An output signal from the tuner circuit of 440 Hz (concert A) indicates that the pitch is in tune. However, if the output signal is 442 HZ (10 cents error), the LED immediately to the right of the in-tune LEDs is illuminated, indicating that the pitch is slightly sharp. Each successive LED to the right indicates an additional 2 Hz of error (sharpness) in the pitch. Likewise, if the output signal is 438 Hz, the LED immediately to the left of the in-tune LEDs is illuminated indicating the signal is slightly flat. Each succeeding LED to the left indicates an additional 2 Hz error (flatness) in pitch.

The tuner display 20 is inlaid in the stringed instrument 1 such that the top surface of the display is flush with the surface of the instrument 1. The tuner display 20 is situated on the guitar such that the LEDs are clearly visible to the musician while holding the instrument in a playing position. In the case of a guitar or like instrument, the display is preferably inlaid in the top of the neck 2 near the body 3 such that the LEDs face upwards, as shown in FIG. 1. Alternatively, the display 20 could be located in the upper horn portion 7 of the body 3. The orientation of the display 20 prevents the LEDs from being readily visible to others viewing the front face 5 of the instrument 1, such as an audience.

The tuning process of the first embodiment is summarized as follows. The musician activates the tuner, either by switching on the on/off switch 12 or by turning the volume control knob 10 to the minimum setting. The musician then plays a string and the pickup senses the pitch of the string's vibration. Preferably, the twelve fret harmonic of the string is played in order to more quickly establish the pitch. Next, the tuner circuit 17 compares the pickup signal to the digital pitch reference values to determine which string has been played and how different, if at all, the pitch is from the closest pitch reference value. The tuner circuit 17 drives the tuner display 20 which automatically indicates whether the pitch of the string is in tune or the degree to which the pitch of the string is sharp or flat.

Next, a second embodiment of the present invention will be described with reference to FIGS. 8–10. An acoustic stringed instrument 80, such as an acoustic guitar, is provided with a tuner 81. FIG. 8 shows an angular view of the front face of the acoustic instrument 80 from beyond the top portion of the instrument. This view corresponds to the angle at which the musician would look into the sound hole 82 when holding the instrument 80 in a playing position. The tuner 81 is attached to the Number One Brace inside of the instrument 80 and visible through the sound hole 82.

Figure 9B:
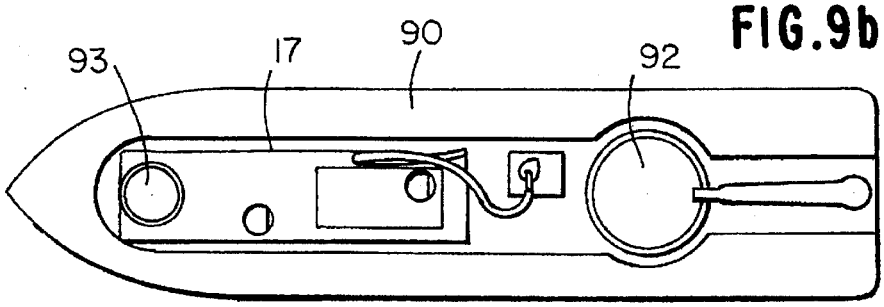
FIG. 9*b* is a cut-away view of the back of the tuner of the second embodiment showing the contents within the shell cavity.
Figure 10:
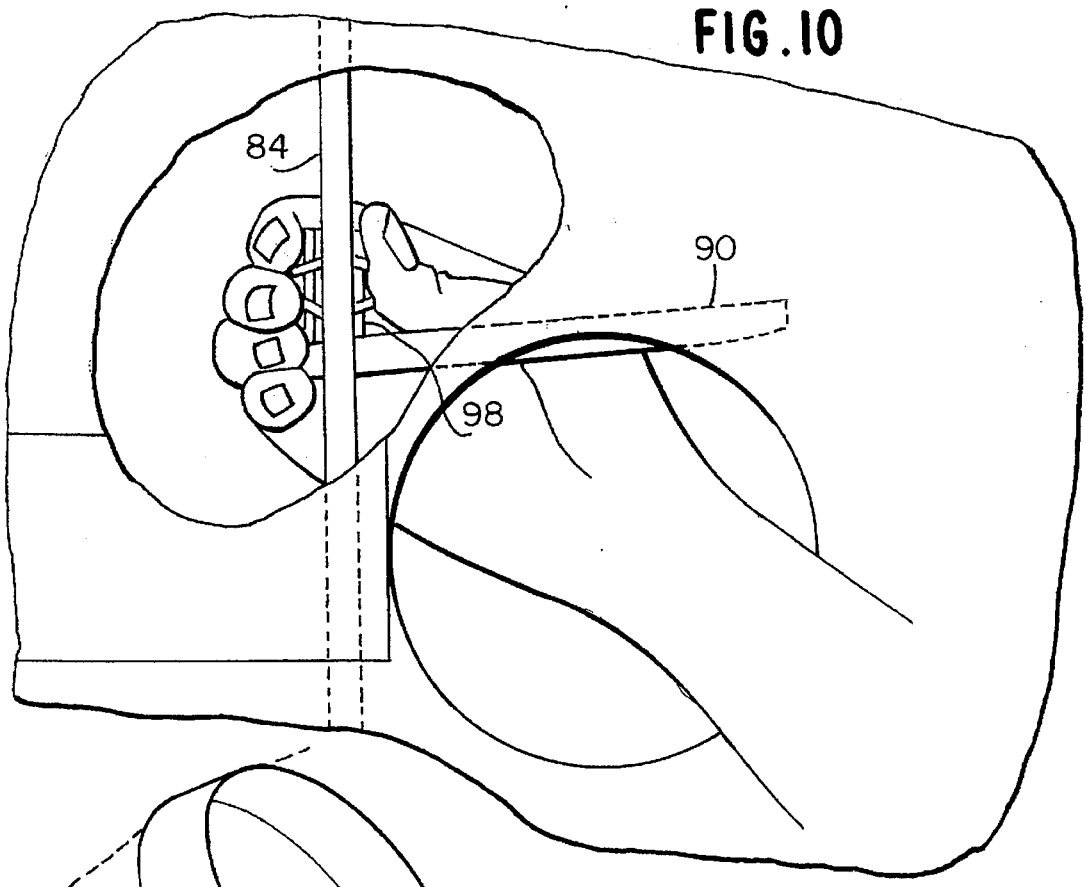
FIG. 10 illustrates how the tuner of the second embodiment is attached to the stringed instrument.

Referring to FIG. 9*a*, the tuner 81 includes a wooden or injection molded shell 90 having a front face 91. The interior of the shell 90 is hollow and contains the tuner components, including the tuner circuit 17 and power source 92, as shown in FIG. 9*b*. The power source 92 is preferably one or more compact batteries, such as conventional lithium calculator-sized batteries.

Unlike an electric stringed instrument, an acoustic stringed instrument does not inherently possess a pickup. Accordingly, the tuner 81 is provided with a condenser microphone 93 located within the shell 90. The microphone 93 detects the acoustic vibrations of the strings and generates corresponding electrical pitch signals in a manner analogous to the pickup 8 of the first embodiment. The location of the microphone 93 within the instrument 80 advantageously prevents background interference from disrupting the tuning process by shielding the microphone 93 from external noise.

The tuner is provided with a three-way switch 94 on the front face 91 of the shell 90. In one position, the tuner 81 is completely deactivated. In a second position, the microphone 93 and tuner circuit 17 are activated, and the microphone pitch signals are sent to the tuner circuit 17. The tuner circuit 17 is operationally the same as the tuner circuit of the first embodiment, with minor modifications to the RC conditioning circuit to accommodate the microphone input. In a third position, the tuner circuit 17 is deactivated, but the microphone 93 remains on, and the microphone output signal is directed to an output jack. This microphone feature allows the musician to amplify the acoustic guitar if desired. Alternatively, a volume fader can be provided on the front face 91 of the shell 90. The volume fader operates in an manner analogous to the volume control knob 10 of the first embodiment. A shielded cable is connected to the microphone output jack and extends through the guitar and out through the end-pin jack (not shown).

The tuner display 95 is located on the front face 91 of the tuner shell 90. Acoustic guitar players use a wide variety of chords, resulting in a need to tune almost any note. To accommodate this need, the string reader portion 96 of the tuner display includes a light emitting element, such as an LED, for each of the 12 pitches in an octave. The tuner circuit 17 is capable of sensing seven octaves from C1 through B8. Each note may be distinguished in the display by forming the indicator elements in the actual shape of the corresponding note (e.g. F, F#, G).

The tune indicator portion 97 of the display consists of three LEDs for in-tune, sharp and flat. The degree to which the pitch is sharp or flat is indicated by the speed at which the sharp or flat LED blinks. In addition, the in-tune LED can be further distinguished in appearance from the sharp and flat LEDs by being made a different color.

The tuner 81 includes a mounting clip 98 attached to the rear of the shell 90. The clip 98 clips onto the Number One upper bout brace 84 within the instrument 80, as shown in FIG. 10. The tuner is oriented such that when the instrument 80 is held in a playing position by the musician, the front face of 91 of the tuner 81 faces directly upward, such that the musician can easily read the display 95 (see FIG. 8). The tuner 81 is not visible when looking into the sound hole 82 from a front plan view. The size and location of the tuner 81 result in a negligible impact on the sound of the guitar 80.

Another aspect of the present invention is an improvement to the strap assembly disclosed by the present inventor in U.S. Pat. No. 4,715,259 which is incorporated herein by reference. The '259 strap assembly includes a strap, worn by a musician over one shoulder, which mounts to the rear face of an instrument body at a balance point, thereby permitting 360° rotation of the instrument body about a horizontal axis at the balance point. To summarize the relevant features of U.S. Pat. No. 4,715,259, the strap assembly includes a flat metal base plate having a tapped hole therein and a ring connector concentrically mounted about the taped hole and electrically insulated from the metal base plate. The base plate is screwed to the rear face of the instrument body at the balance point with the ring connector facing outwardly.

The assembly further includes an elongated, electrically-insulated molded arm having an inboard end with a first hole therethrough and an outboard end with a second hole therethrough. Both holes lie along a longitudinal center line of the arm at right angles to the center line. A retainer button projects through a first end of the strap, and is rotatably mounted within the first hole at the inboard end of the arm via a metal sleeve. The button is threaded into the tapped hole of the base plate such that the arm is rotatably attached to the base plate. Thus, this arrangement provides the mechanical attachment of the arm to the instrument body and fixes the first end of the strap to the arm as well. A screw passes through the second hole at the outboard end of the arm and through the second end of the strap and is threadedly fixed to a retainer disk underlying that end of the strap. Thus, both ends of the strap are permanently attached to the arm which in turn is rotatably attached to the rear face of the instrument at the balance point.

One end of a shielded cable is integrally molded into the arm and is electrically connected to two radially spaced, electrically insulated contacts having portions projecting outward from the arm. The contacts are formed of spring metal and form an electrical connection with the instrument body. Specifically, one contact engages the ring connector which serves as a "hot terminal", and the other contact engages the metal face plate which serves as ground, thereby completing the electrical connection. The other end of the shielded cable terminates in an output jack which can be connected to an external amplifier. Electrical signals from pickups mounted on the instrument body are transmitted to the external amplifier through the connection and cable. Thus, the strap attachment provides both a mechanical and electrical connection between the instrument body and the strap such that the instrument can be rotated smoothly about the axis of the balance point while maintaining the electrical connection.

Figure 16A:
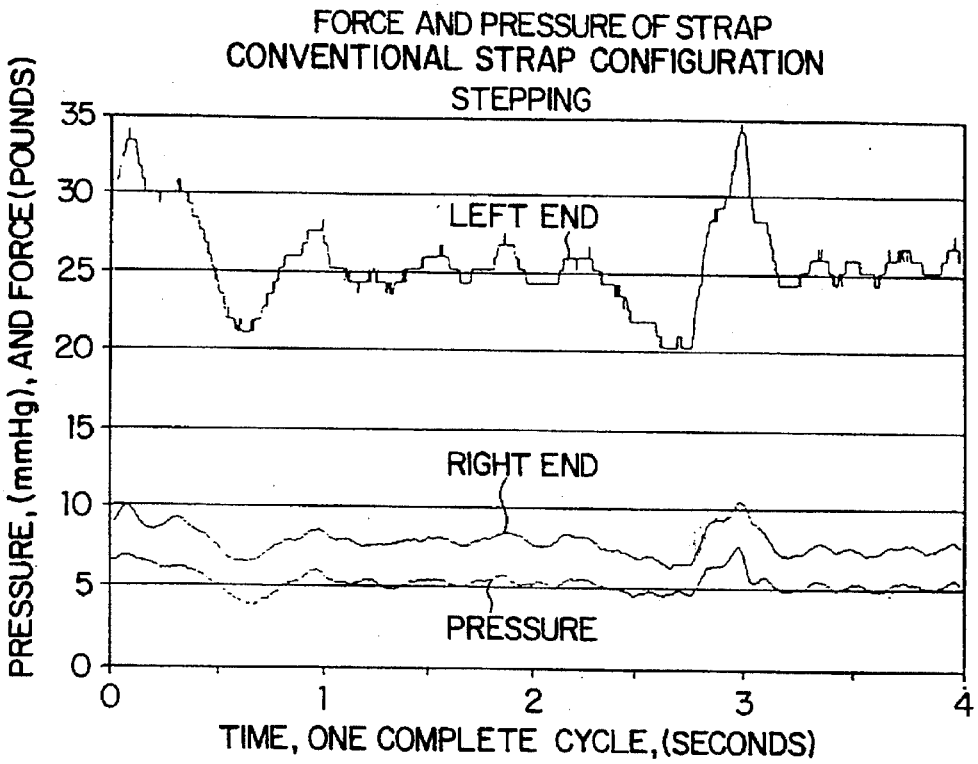
FIGS. 16A and 16B are graphs showing the force and pressure caused by a conventional strap and the force and pressure caused by the strap assembly of U.S. Pat. No. 4,715,259, respectively.
Figure 16B:
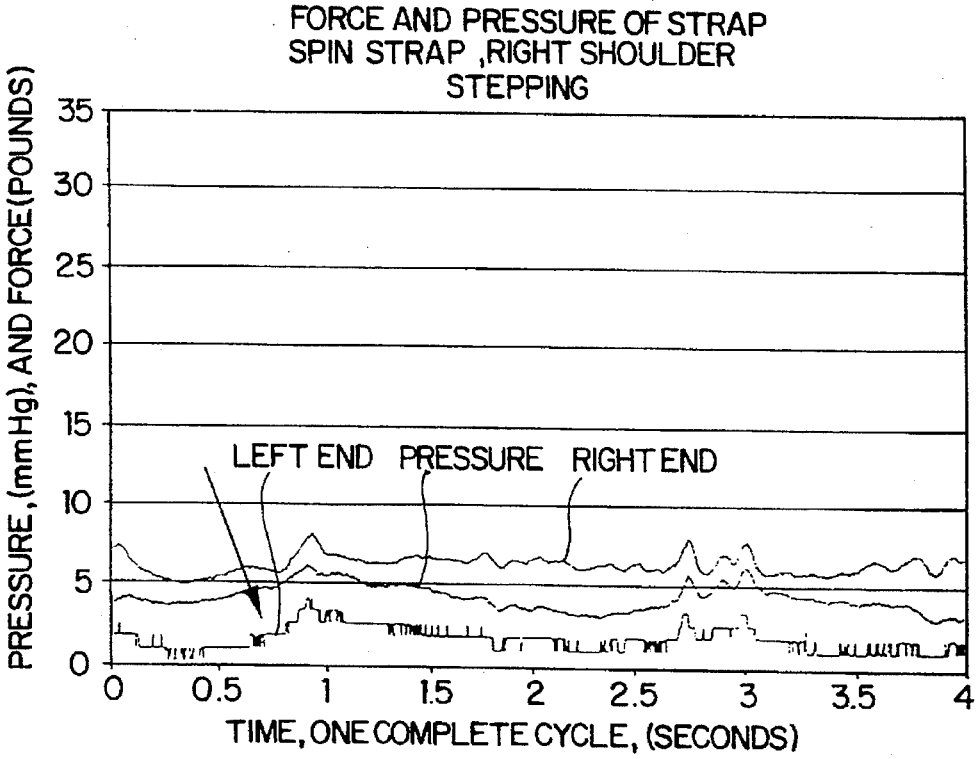

The '259 strap assembly was the subject of a physiological study performed at The Pennsylvania State University. The study compared the '259 strap assembly to conventional straps with regard to force and pressure distribution on the shoulder and back, electromyograph activity of selected muscles, and heart rate. As illustrated by FIGS. 16A and 16B, the resulting force and pressure caused by the '259 strap assembly was found to be substantially less than the force and pressure caused by the conventional strap configuration. An additional study was conducted by Medart, USA, Inc. in which maximum EMG RMS values were obtained under varying operating conditions. The Medart study revealed that, relative to the conventional strap, the '259 strap assembly reduced muscle activity by 54% on the musician's left side and by 70% on the musician's right side. The table of FIG. 17 summarizes the findings of this study.

Figure 11:
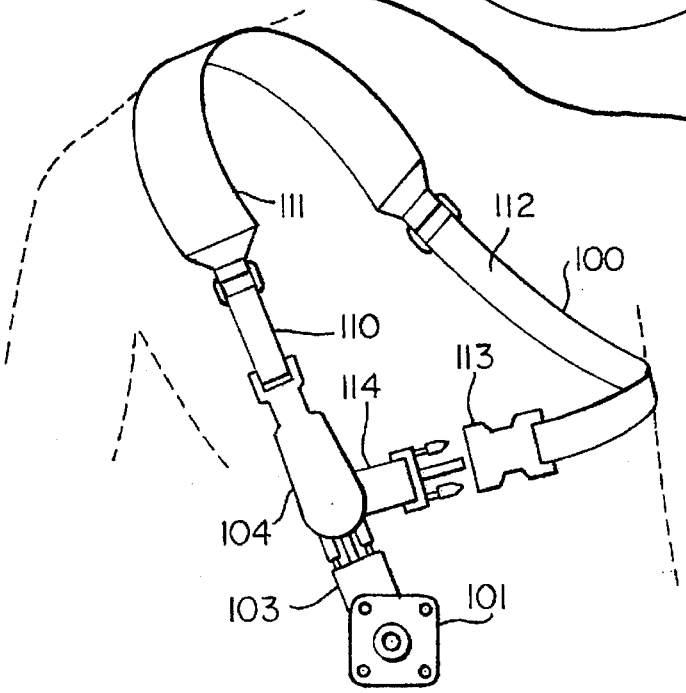
FIG. 11 is a perspective view of the strap assembly of the present invention.

FIG. 11 illustrates the improved strap assembly of the present invention. The strap assembly 100 includes a base plate 101 having a tapped hole therein and a ring connector concentrically mounted about the tapped hole. The base plate 101 mounts on the rear face of a stringed instrument at a balance point which coincides with the instrument's center of gravity. In other words, the balance point is located on the body of the instrument such that the weight of the instrument is equally distributed about that point in at least the longitudinal and transverse directions. The center of gravity mounting of the instrument advantageously minimizes the amount of torque experienced by the musician through the strap assembly. As described below, the guitar body can be contoured to provide, on the rear face, a balance point which is substantially balanced in the thickness or z-axis direction as well. The base plate 101 is substantially the same as that disclosed in U.S. Pat. No. 4,715,259.

An electrically-insulated pivot assembly is provided which has a male pivot arm 103 and a female pivot arm 104. An inboard end of the male pivot arm 103 has a hole through one face which lies along a longitudinal center line of the male pivot arm 103 at a right angle to the center line. A screw is rotatably mounted within the inboard end via a metal sleeve, and projects through the hole. The screw is threaded into the tapped hole of the base plate 101 such that the male pivot arm 103 is rotatably connected to the base plate 101. By way of comparison, the screw provides the same function as the button of U.S. Pat. No. 4,715,259, in that the male pivot arm 103 is mechanically connected to the base plate 101, and the instrument can rotate 360° about the axis of the base plate 101. However, unlike the button, the screw does not extend through to the other side of the male pivot arm 103 to secure one end of the strap, but instead terminates within the male pivot arm 103.

The outboard end of the male pivot arm 103 is provided with lock tabs 106. The female pivot arm 104 has, at one end, a housing 107 which receives the lock tabs 106. The lock tabs 106 slide into the housing 107 and clip into openings on the sides of the housing, thereby locking the male pivot arm 103 to the female pivot arm 104 in a fixed position. The male pivot arm 102 can be released from the female pivot arm 103 by simultaneously pressing inwardly on both lock tabs with the thumb and a finger.

An electrical connection to the instrument body is provided through the base plate and male pivot arm 103 in a manner similar to the electrical connection of U.S. Pat. No. 4,715,259. Specifically, a shielded cable is integrally molded into the male pivot arm 103 and is electrically connected to two radially spaced, electrically insulated contacts having portions projecting outward from the male pivot arm. The contacts are formed of spring metal and form an electrical connection with the instrument body. One contact engages the ring connector which serves as a "hot terminal", and the other contact engages the metal face plate which serves as ground, thereby completing the electrical connection. The other end of the shielded cable terminates in a male output connector 108 which is centrally located between the two lock tabs 106 on the outboard end of the male pivot arm 103, as illustrated in FIG. 12. The female pivot arm 104 contains a female receiving connector 109 which forms an electrical connection with the male output connector 108 when the male pivot arm 103 is inserted into the housing 107 of the female pivot arm 104. FIG. 13*a* shows a schematic diagram of the male electrical connector 108 and female receiving connector 109.

Referring to the circuit diagram of FIG. 13*b*, when the female receiving connector 109 is not connected to the male output connector 108, the female receiving connector 109 is shorted to ground in order to eliminate any hum or contact noise to the amplifier. The electrical connection formed by the male electrical connector 108 and receiving connector 109 is a make-before-break connection so that when the connection is formed, no noise or sound is generated at the output. From the female receiving connector 109, a cable carries the output signal from the instrument to an output jack at the back of the strap. The output jack can be attached to an external amplifier.

Referring to FIG. 11, the top of the female pivot arm 104 is connected to a 1 inch webbed strap 110 which has a conventional adjuster. The strap is connected to a padded section 111 which rests on the musician's shoulder. The other end of the padded section 111 is connected to a second webbed strap 112 which has an adjuster and which terminates in a quick release clip housing 113.

As shown in FIGS. 11 and 12, a quick release clip 114 is permanently rotatably attached to the lower end of the female pivot arm 103. The quick release chip has lock tabs which lock into quick release clip housing 113 to secure the strap assembly to the musicians's body. The strap rests on the right shoulder of the musician and wraps around the musician's body, thereby distributing the instrument's weight evenly on the musician. The entire strap assembly can be detached by simultaneously squeezing the lock tabs of the quick release clip 114.

Operation of the strap assembly is summarized as follows. When the musician decides to change instruments, the currently attached instrument can be detached by releasing the male pivot arm 103 from the female pivot arm 104 by squeezing the lock tabs 106 on the outboard end of the male pivot arm 103. This simultaneously severs the mechanical and electrical connection of the instrument without requiring removal of the strap assembly. Another instrument having a similar male pivot arm attached to its rear face can then be attached to the strap simply by inserting the lock tabs of the male pivot arm into the housing 107 of the female pivot arm 104. This connection simultaneously establishes both the mechanical and electrical connection of the instrument. Thus, without removing the strap assembly, the musician can detach a first instrument and attach a second instrument simply by releasing the lock tabs of the first instrument and then inserting the lock tabs of the second instrument into the housing 107. In addition, the musician can quickly remove the entire strap assembly while an instrument is still attached, by the releasing the quick release clip. Thus, only one motion is required to remove the strap, cord and instrument.

The strap assembly of the present invention is not limited to use with only stringed instruments. The strap assembly can be used with any instrument which is normally held by the musician and supported by a strap. For example, the strap assembly can be used with a saxophone.

In another aspect of the present invention, the body of the instrument is shaped to work with the strap assembly to minimize torque forces and stress on the musician's neck and shoulders. Referring to FIG. 1, the front face of the instrument's neck 2 defines a front face plane, with the strings 4 running in a longitudinal, x-axis direction and the frets 9 running in a transverse, y-axis direction. The thickness of the guitar extends in a third z-axis direction which is orthogonal to the front face plane. The positive z-direction can be defined as extending out of the front face 5 of the instrument, and the negative z-direction can be defined as extend through the back of the instrument towards the musician.

FIG. 14 illustrates the shape of the instrument body 3 along the longitudinal x-axis as viewed from the top of the instrument. FIG. 15 illustrates the shape of the instrument body 3 along the transverse y-axis as viewed from the side of the instrument. The body shape shown in FIG. 15 is somewhat exaggerated to emphasis the nature of the curvature. The actual curvature along the y-axis For purposes of description, regions of the instrument body can be defined as follows: the body has an upper portion 120 which lies above the neck and a lower portion 121 which lies below the neck; and the body has a distal end 122 which lies beyond the end of the strings and bridge, and a near end 123 which includes the upper horn portion 7. In other words, the upper and lower portions divide the instrument into two regions lying about the x-axis, and the near and distal ends divide the instrument into two regions lying about the y-axis.

The center of the front face 5 of the body 3 (near the bridge 16) is substantially coplanar with the front face plane. Along the longitudinal x-axis, the instrument body 3 curves out of the front face plane in the negative z-direction at both the near and distal ends, as shown in FIG. 14. Both the upper and lower portions of the body 3 curve out of the front face plane in the negative z-direction along the transverse y-axis, as shown in FIG. 15. The thickness of the body gradually decreases from the bottom of the lower portion 121 to the top of the upper portion 120.

The curvature of the instrument body serves several purposes. First, the negative z-direction curvature conforms to the shape of the musician's body, thereby causing the mass of the instrument to remain close to the musician's body when the instrument is held in a playing position. This ergonomic arrangement reduces the effective moment arm of the instrument as compared to a conventional instrument whose slab body extends away from the musician's body. The reduction of the effective moment arm reduces the torque experience by the musician through the strap assembly.

As illustrated in FIG. 15, the curvature of the instrument body 3 allows the mounting of base plate 101 to be near the center of gravity in the z-direction, thus providing three-dimensional balance point. With a conventional slab body, the mounting point cannot be located near the z-direction center of gravity, since the rear face does not present such a point. In addition, the decrease in thickness results in a reduction of the weight of the body 3, which in turn reduces torque and stress experienced by the musician through the strap assembly.

As illustrated in FIG. 14, another advantage of the body curvature is that the curvature of the near end 123 allows the tuner display 20 to be inlaid discreetly in the neck near the end of the fingerboard. In this location, the tuner display 20 is easily viewed by the musician. Additionally, this location minimizes the distance between the display and the tuner circuit, thereby minimizing the routing of wires through the body 3.

Typically, a stringed instrument's lower body portion is roughly symmetric to its upper body portion, with the conventional upper horn often being somewhat larger than the lower horn counterpart. According to another aspect of the present invention, as shown in FIG. 1, the instrument body 3 is shaped such that the lower horn portion substantially eliminated. The lower portion of the instrument has a conventional rounded front profile at the distal end. However, as the lower portion extends towards the near end, the lower portion tapers upward towards the neck 2 in the transverse y-axis direction, such that the lower portion is no more than a narrow strip below the neck 2 at the near end.

This construction of the lower portion has several advantages. Specifically, the absence of the lower horn permits the musician to hold and play the instrument in the same relative position while sitting as while standing. The instrument body can pivot freely without a lower horn pressing against the musician's leg and constraining the range of motion of the instrument. In addition, the elimination of the lower horn substantially reduces the weight of the instrument, thereby reducing the torque and pressure experienced by the musician through the strap assembly.

What is claimed is:

1. A stringed instrument including an on-board tuner comprising:

a detector for sensing vibrations produced by said stringed instrument and for generating an electrical pitch signal representative of a pitch of the vibrations, said detector being mounted in a cavity of said stringed instrument;

a tuner circuit including: storage means for storing a set of pitch reference values representing frequencies of musical notes; comparison means for comparing the pitch signal to the pitch reference values to determine which of the pitch reference values is a closest pitch reference value and to determine a pitch deviation representing a difference in frequency between the pitch signal and the closest pitch reference value; and display control means for generating tuner circuit output signals indicative of the pitch of the vibrations relative to the closest pitch reference value, said tuner circuit being disposed in a cavity of said stringed instrument;

a display for indicating a degree to which the pitch of the vibrations deviates from the closest pitch reference value, said display receiving the tuner circuit output signals and including: a string reader portion having a series of light emitting elements corresponding to musical notes, wherein one of the light emitting elements is illuminated in response to the tuner circuit output signals to indicate the closest pitch reference value; and a tune indicator portion indicating the degree to which the pitch of the vibrations deviates from the closest pitch reference value, said display being mounted on said stringed instrument such that said display is readable by a musician holding said stringed instrument in a normal playing position; and an on-board power source for providing power to said tuner.

2. A stringed instrument according to claim 1, wherein the tune indicator portion of said display comprises:

at least a first light emitting element being illuminated to indicate that the pitch of the vibrations is substantially in tune with the closest pitch reference value;

a second light emitting element being illuminated to indicate that the pitch of the vibrations is flat relative to the closest pitch reference value, such that the second light emitting element blinks at a rate indicative of a degree to which the pitch of the vibrations is flat; and a third light emitting element being illuminated to indicate that the pitch of the vibrations is sharp relative to the closest pitch reference value, such that the third light emitting element blinks at a rate indicative of a degree to which the pitch of the vibrations is sharp.

3. A stringed instrument according to claim 1, further comprising: a body;

a neck extending from said body in a longitudinal direction and having a front surface and a top surface lying substantially orthogonal to the front surface; and a volume control for controlling electrical amplification of said stringed instrument, and wherein said detector is a pickup which sends the pitch signal to the volume control, and said display is inlaid in the top surface of said neck such that said display is substantially flush with the top surface of said neck.

4. A stringed instrument according to claim 3, wherein the tune indicator portion of said display comprises:

at least a first light emitting element being illuminated to indicate that the pitch of the vibrations is substantially in tune with the closest pitch reference value;

a second light emitting element being illuminated to indicate that the pitch of the vibrations is flat relative to the closest pitch reference value, such that the second light emitting element blinks at a rate indicative of a degree to which the pitch of the vibrations is flat; and a third light emitting element being illuminated to indicate that the pitch of the vibrations is sharp relative to the closest pitch reference value, such that the third light emitting element blinks at a rate indicative of a degree to which the pitch of the vibrations is sharp.

5. A stringed instrument according to claim 3, wherein the tune indicator portion of said display comprises:

at least one in-tune light emitting element being illuminated to indicate that the pitch of the vibrations is substantially in tune with the closest pitch reference value;

a first series of light emitting elements located on one side of said in-tune light emitting element, wherein light emitting elements of the first series which are successively further displaced from the in-tune light emitting element are illuminated to indicate a successively greater degree of flatness of the pitch of the vibrations relative to the closest pitch reference value; and a second series of light emitting elements located on another side of said in-tune light emitting element, wherein light emitting elements of the second series which are successively further displaced from the in-tune light emitting element are illuminated to indicate a successively greater degree of sharpness of the pitch of the vibrations relative to the closest pitch reference value.

6. A stringed instrument according to claim 3, wherein said tuner circuit receives the pitch signal from said volume control only when said volume control is adjusted to a minimum volume setting.

7. A stringed instrument according to claim 3, further comprising a tuner on/off switch, wherein said pickup sends the pitch signal to the tuner circuit directly and said power source is activated by said tuner on/off switch such that said tuner circuit operates independently from said volume control.

8. A stringed instrument according to claim 1, wherein said display is no more than one inch in length.

9. A stringed instrument according to claim 1, wherein:

said stringed instrument is an acoustic stringed instrument having a body with a sound hole;

said detector is a microphone located within the body of said stringed instrument such that said microphone is substantially shielded from sound interference from external sources; and said display is mounted within the body of said stringed instrument such that said display is visible through the sound hole.

10. A stringed instrument according to claim 9, further comprising a three way switch, wherein:

a first setting of said switch deactivates said power source;

a second setting of said switch activates said microphone such that the pitch signal is provided to the tuner circuit; and a third setting of said switch activates said microphone such that the pitch signal is provided to an output jack for external amplification.

11. A stringed instrument according to claim 1, further comprising:

a body having opposite near and distal ends, an upper portion, a lower portion and a thickness; and a neck having a substantially planar front surface defining a front face plane and a top surface lying substantially orthogonal to the planar front surface, said neck extending from the near end of said body in a longitudinal direction, such that the upper portion of said body lies above said neck and the lower portion of said body lies below said neck, wherein:

the near and distal ends of said body curve out of said plane;

the upper and lower portions of said body curve out of said plane; and the thickness of said body decreases from a bottom of the lower portion to a top of the upper portion, and wherein said display is inlaid in the top surface of said neck adjacent to the near end of said body.

12. A stringed instrument according to claim 11, further comprising:

a strap assembly for a musical instrument, including:

a flat metal base plate attached to a rear face of said body of said instrument at a balance point thereof;

a ring connector mounted to said base plate and having an integral hot terminal extending through said base plate to said body of said instrument, said ring connector being electrically insulated from said base plate;

a male pivot arm having a body formed of a molded electrically insulative material and having opposite inboard and outboard ends, said male pivot arm being rotatably attached to said base plate at the inboard end, said male pivot arm including: locks tabs located at the outboard end for providing a mechanical connection; a male output connector located at the outboard end for providing an electrical connection; electrical contacts which form an electrical connection with the hot terminal of said ring connector and with said base plate serving as ground; and an electrically shielded cable connected on one end to the male output connector and on another end to the electrical contacts;

a female pivot arm having a body formed of a molded electrically insulative material and having opposite first and second ends, said female pivot arm including: a housing located on the first end for receiving the lock tabs of said male pivot arm; and a female receiving connector located within the housing for receiving the male output connector, wherein said male and female pivots arms are locked in a fixed position and an electrical connection is formed between the male output connector and the female receiving connector when the lock tabs of said male pivot arm are inserted into the housing of said female pivot arm, and wherein said male pivot arm and said instrument are mechanically and electrically disconnected from said female pivot arm when the lock tabs are released from the housing of said female pivot arm;

a padded section for resting on a musician's shoulder;

a first strap section connected on one end to the second end of said female pivot arm and on another end to said padded section;

a second strap section having on one end a quick release clip housing and being connected on another end to said padded section;

a quick release clip being attached to the first end of said female pivot arm and having lock tabs which, when inserted into the quick release clip housing, secure said strap assembly to a musician's body, and, when released from the quick release clip housing, allow a musician to remove said strap assembly along with said instrument; and an output cable terminating on one end with the female receiving connector and terminating on another end with an output jack.

13. A tuner for tuning a stringed instrument, comprising:

a detector for sensing vibrations produced by said stringed instrument and for generating an electrical pitch signal representative of a pitch of the vibrations, said detector being mounted in a cavity of said stringed instrument;

a tuner circuit including: storage means for storing a set of pitch reference values representing frequencies of musical notes; comparison means for comparing the pitch signal to the pitch reference values to determine which of the pitch reference values is a closest pitch reference value and to determine a pitch deviation representing a difference in frequency between the pitch signal and the closest pitch reference value; and display control means for generating tuner circuit output signals indicative of the pitch of the vibrations relative to the closest pitch reference value, said tuner circuit being disposed in a cavity of said stringed instrument;

a display for indicating a degree to which the pitch of the vibrations deviates from the closest pitch reference value, said display receiving the tuner circuit output signals and including: a string reader portion having a series of light emitting elements corresponding to musical notes, wherein one of the light emitting elements is illuminated in response to the tuner circuit output signals to indicate the closest pitch reference value; and a tune indicator portion indicating the degree to which the pitch of the vibrations deviates from the closest pitch reference value, said display being mounted on said stringed instrument such that said display is readable by a musician holding said stringed instrument in a normal playing position; and a power source for providing power to said tuner.

14. A tuner according to claim 13, wherein the tune indicator portion of said display comprises:

at least a first light emitting element being illuminated to indicate that the pitch of the vibrations is substantially in tune with the closest pitch reference value;

a second light emitting element being illuminated to indicate that the pitch of the vibrations is flat relative to the closest pitch reference value, such that the second light emitting element blinks at a rate indicative of a degree to which the pitch of the vibrations is flat; and a third light emitting element being illuminated to indicate that the pitch of the vibrations is sharp relative to the closest pitch reference value, such that the third light emitting element blinks at a rate indicative of a degree to which the pitch of the vibrations is sharp.

15. A tuner according to claim 13, wherein:

said stringed instrument includes a neck having a top surface; and said display is inlaid in the top surface of the neck such that said display is substantially flush with the top surface of the neck.

16. A tuner according to claim 15, wherein the tune indicator portion of said display comprises:

at least a first light emitting element being illuminated to indicate that the pitch of the vibrations is substantially in tune with the closest pitch reference value;

a second light emitting element being illuminated to indicate that the pitch of the vibrations is flat relative to the closest pitch reference value, such that the second light emitting element blinks at a rate indicative of a degree to which the pitch of the vibrations is flat; and a third light emitting element being illuminated to indicate that the pitch of the vibrations is sharp relative to the closest pitch reference value, such that the third light emitting element blinks at a rate indicative of a degree to which the pitch of the vibrations is sharp.

17. A tuner according to claim 15, wherein the tune indicator portion of said display comprises:

at least one in-tune light emitting element being illuminated to indicate that the pitch of the vibrations is substantially in tune with the closest pitch reference value;

a first series of light emitting elements located on one side of said in-tune light emitting element, wherein light emitting elements of the first series which are successively further displaced from the in-tune light emitting element are illuminated to indicate a successively greater degree of flatness of the pitch of the vibrations relative to the closest pitch reference value; and a second series of light emitting elements located on another side of said in-tune light emitting element, wherein light emitting elements of the second series which are successively further displaced from the in-tune light emitting element are illuminated to indicate a successively greater degree of sharpness of the pitch of the vibrations relative to the closest pitch reference value.

18. A tuner according to claim 13, wherein said display is no more than one inch in length.

19. A tuner according to claim 13, wherein:

said stringed instrument is an acoustic stringed instrument having a body with a sound hole;

said detector is a microphone located within the body of said stringed instrument such that said microphone is substantially shielded from sound interference from external sources; and said display is mounted within the body of said stringed instrument such that said display is visible through the sound hole.

20. A tuner according to claim 19, further comprising a three way switch, wherein:

a first setting of said switch deactivates said power source;

a second setting of said switch activates said microphone such that the pitch signal is provided to the tuner circuit; and a third setting of said switch activates said microphone such that the pitch signal is provided to an output jack for external amplification.

* * * * *